US006169067B1

(12) United States Patent
Childs et al.

(10) Patent No.: US 6,169,067 B1
(45) **Date of Patent: *Jan. 2, 2001**

(54) DRYER-ACTIVATED FABRIC CONDITIONING COMPOSITIONS WITH IMPROVED STABILITY CONTAINING SUGAR DERIVATIVES

(75) Inventors: Stephen Lee Childs; Rodolfo Delgado, both of Cincinnati; Rolf Knights Hultsch, Columbus, all of OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/542,994

(22) Filed: Oct. 13, 1995

(51) Int. Cl.[7] ..... C11D 1/83
(52) U.S. Cl. ..... 510/520; 510/519
(58) Field of Search ..... 510/519, 526, 510/504, 505

(56) References Cited

U.S. PATENT DOCUMENTS

| | | | | |
|---|---|---|---|---|
| 4,022,938 | * | 5/1977 | Zaki et al. | 427/242 |
| 5,185,088 | * | 2/1993 | Hartman et al. | 252/8.6 |
| 5,300,238 | | 4/1994 | Taylor | 252/8.6 |
| 5,376,287 | * | 12/1994 | Burcher, Sr. et al. | 252/8.8 |
| 5,474,641 | * | 12/1995 | Severns | 252/8.9 |
| 5,476,599 | | 12/1995 | Rusche et al. | 252/88 |
| 5,500,138 | * | 3/1996 | Bacon et al. | 252/8.8 |
| 5,503,756 | * | 4/1996 | Corona et al. | 252/8.8 |
| 5,531,910 | * | 7/1996 | Severns et al. | 510/102 |
| 5,536,421 | * | 7/1996 | Hartman et al. | 8/137 |
| 5,559,088 | * | 9/1996 | Severns et al. | 510/102 |
| 5,562,847 | * | 10/1996 | Waite et al. | 510/519 |
| 5,578,234 | * | 11/1996 | Corona, III et al. | 510/519 |
| 5,652,205 | * | 7/1997 | Hartman et al. | 510/101 |
| 5,700,387 | * | 12/1997 | Haq et al. | 252/8.63 |
| 5,716,918 | * | 2/1998 | Sivik et al. | 510/101 |

FOREIGN PATENT DOCUMENTS

704522 A2 * 4/1996 (EP) .

* cited by examiner

*Primary Examiner*—John R. Hardee
(74) *Attorney, Agent, or Firm*—Frank C. Turner

(57) ABSTRACT

Dryer-activated fabric softening compositions and articles having improved stability, for use in an automatic clothes dryer consisting essentially of: (A) from about 30% to about 75% of a diester quaternary ammonium (DEQA) compound having the formula:

$$[CH_2CH_2OH][CH_3]^+N[CH_2CH_2OC(O)R]_2X^-$$

wherein R is a long chain, saturated and/or unsaturated, $C_8$–$C_{30}$ hydrocarbyl, or substituted hydrocarbyl substituent and mixtures thereof, and the counterion, $X^-$, can be any softener-compatible anion; and, (B) nonionic softener at a level of from about 15% to about 50%, where the nonionic softener is fatty acid partial ester of sorbitan; and wherein the ratio of component (A) to component (B) is from about 3:1 to about 1:1.

15 Claims, No Drawings

DRYER-ACTIVATED FABRIC CONDITIONING COMPOSITIONS WITH IMPROVED STABILITY CONTAINING SUGAR DERIVATIVES

TECHNICAL FIELD

The present invention relates to an improvement in dryer activated, e.g., dryer-added, softening products, compositions, and/or the process of making these compositions. These products and/or compositions are either in particulate form, compounded with other materials in solid form, e.g., tablets, pellets, agglomerates, etc., or, preferably, attached to a substrate.

BACKGROUND OF THE INVENTION

Certain chemical compounds have long been known in the art to possess the desired quality of imparting softness to textile fabrics. The quality of "softness" or being "soft" is well defined in the art, and, as used herein, means that quality of the treated fabric whereby its handle or texture is smooth, pliable, and fluffy, and not rough or scratchy to the touch. Known generally as "fabric softeners," these compounds have long been used by homemakers in the laundry, and by the textile industry to soften a finished fabric.

Additionally, many of these compounds act to reduce the "static cling" of the treated fabrics. Static cling is generally the phenomenon of a fabric adhering to another object or to parts of itself as a result of static electrical charges located on the surface of the fabric. It can also cause the adherence of lint, dust, and other undesired substances to the fabric. It is noticeably present in unsoftened fabrics that are freshly washed and dried in an automatic hot airdryer. By softening and reducing the static cling of a fabric, it is more comfortable when worn. Such treated fabrics additionally are easier to iron, and have fewer hard-to-iron wrinkles.

Another means of providing fabric conditioning is disclosed in Gaiser, U.S. Pat. No. 3,442,692, issued May 6, 1969, incorporated herein by reference, comprising a fabric-conditioning composition in conjunction with a dispensing means for use in a hot air dryer. Preferred articles had the fabric-conditioning composition releasably affixed to an absorbent substrate, such as a nonwoven tissue, in the form of an impregnate or coating of cationic fabric-conditioning agent. The use of certain polyesters, especially sorbitan esters as auxiliary fabric-conditioning agents in products of this kind, is disclosed in Zaki et al., U.S. Pat. No. 4,022,938, issued May 10, 1977, incorporated herein by reference.

The formulation of dryer added fabric softeners must balance softening performance with stability and processability. In particular, the temperature stability of the fabric softening composition, and its ability to adhere to a particular substrate, are critical to commercial usefulness of the composition. The softening agents with the most desirable softening/antistatic performance profile often present processing and shelf stability problems. Compositions which are difficult to process tend to block or gum up the machinery used to produce the end product. Some compositions release well during the drying cycle, but leave stains on the insides of packaging. Such staining indicates the loss of softener active to the packaging material. Highly stable compositions may avoid staining packaging, but fail to release effectively during the drying cycle. Thus, there remains a need for fabric softening compositions which can effectively be processed and stored, yet still provide fabric softening and antistatic benefits.

The object of the present invention is to provide an improved composition and articles for biodegradable dryer added fabric softening that demonstrate improved processability and shelf stability.

It has been discovered that the combination of a specific diester quaternary ammonium compound in conjunction with a specific class of nonionic softener provide unexpectedly improved processability and shelf stability while maintaining highly desirable fabric softening and antistatic performance.

SUMMARY OF THE INVENTION

The present invention relates to biodegradable dryer-activated fabric softening compositions and articles having improved stability, for use in an automatic clothes dryer. These compositions and/or articles consist essentially of:

(A) from about 30% to about 75%, preferably from 50% to about 70%, and most preferably from about 60% to about 65%, of a diester quaternary ammonium (DEQA) compound having the formula:

$$[CH_2CH_2OH][CH_3]^+N[CH_2CH_2OC(O)R]_2X^-$$

wherein R is a long chain, saturated and/or unsaturated, $C_8$–$C_{30}$ hydrocarbyl, or substituted hydrocarbyl substituent and mixtures thereof, and the counterion, $X^-$, can be any softener-compatible anion; and (B) nonionic softener at a level of from about 15% to about 50%, preferably from about 25% to about 45%, and most preferably from about 30% to about 40%, wherein said nonionic softener is fatty acid partial ester of sorbitan, wherein each fatty acid moiety contains from about 8 to about 30 carbon atoms, and wherein said partial ester contains from about 1 to about 3 fatty acid groups per molecule; and (C) optionally, components selected from the group consisting of:

(1) from 0% to about 10% of soil release agent, (2) from 0% to about 60% of cyclodextrin/perfume inclusion complexes and/or free perfume, (3) from 0% to about 2% of stabilizer;

wherein the ratio of component (A) to component (B) is from about 3:1 to about 1:1, preferably from about 68:32 to about 55:45, and most preferably about 2:1.

The amount of (A) present is at least sufficient to provide improved antistatic effects and is not so much as to cause the composition to have unacceptable physical characteristics, e.g., stickiness. The active components (A) and (B) can contain unsaturation to provide improved antistatic benefits.

DETAILED DESCRIPTION OF THE INVENTION

The use of biodegradable diester quaternary ammonium compounds is well recognized in the art. The diester quaternary ammonium compound, $$[CH_3]_2^+N[CH_2CH_2OC(O)R]_2X^-$$

where R is a long chain hydrocarbyl, and X is a softener compatible anion, is well known as a highly desirable biodegradable softener. This softener active has met with significant commercial success due, in large part, to its excellent softening performance and biodegradability. However, in formulations similar to the present invention, this dimethyl DEQA compound exhibits unexpected stability problems during processing. Surprisingly, it has been found that the substitution of one methyl group at the quaternized nitrogen with a ethanol moiety, as found in component (A) of the present invention, eliminates these processing problems.

The present invention relates to fabric softening compositions and articles having improved antistatic effects, for use in an automatic clothes dryer. These compositions consist essentially of:

(A) from about 30% to about 75%, preferably from 50% to about 70%, and most preferably from about 60% to about 65%, of a diester quaternary ammonium (DEQA) compound having the formula:

$$[CH_2CH_2OH][CH_3]^+N[CH_2CH_2OC(O)R]_2X^-$$

wherein R is a long chain, saturated and/or unsaturated, $C_8$–$C_{30}$ hydrocarbyl, or substituted hydrocarbyl substituent and mixtures thereof, and the counterion, $X^-$, can be any softener-compatible anion; and (B) nonionic softener at a level of from about 15% to about 50%, preferably from about 25% to about 45%, and most preferably from about 30% to about 40%, wherein said nonionic softener is fatty acid partial ester of sorbitan, wherein each fatty acid moiety contains from about 8 to about 30 carbon atoms, and wherein said partial ester contains from about 1 to about 3 fatty acid groups per molecule; and (C) optionally, components selected from the group consisting of:

(1) from 0% to about 10% of soil release agent, (2) from 0% to about 60% of cyclodextrin/perfume inclusion complexes and/or free perfume, (3) from 0% to about 2% of stabilizer.

wherein the ratio of component (A) to component (B) is from about 3:1 to about 1:1, preferably from about 68:32 to about 55:45, and most preferably about 2:1.

The ratio of (A) to (B) is selected based upon a balance of softening/antistatic performance and processability. Component (A) adds to softening/antistatic performance while component (B) provides processing benefit. A ratio above about 3:1 of component (A) to component (B) adversely influences the processing of the composition. Ratios below about 1:1 of component (A) to component (B) unfavorably affect the softening/antistatic performance of the composition. A ratio of component (A) to component (B) of about 68:32 exhibits substantially superior processability to a ratio of 3:1, and a ratio of about 2:1 is optimum.

The active components can contain unsaturation for additional antistatic benefits. The components are selected so that the resulting fabric treatment composition has a melting point above about 38° C.; is flowable at dryer operating temperatures; and is readily processable.

(A) Quaternary Ammonium Compound

Compositions of the present invention also contain as essential ingredients from about 30% to about 75%, preferably from 50% to about 70%, and most preferably from about 60% to about 65%, of diester quaternary ammonium (DEQA) compound of the formula:

$$[CH_2CH_2OH][CH_3]^+N[CH_2CH_2OC(O)R]_2X^-$$

wherein R is a long chain, saturated (Iodine Value—"IV" of less than 3) and/or unsaturated (Iodine Value—"IV" of from about 3 to about 60), $C_8$–$C_{30}$, hydrocarbyl, or substituted hydrocarbyl substituent and mixtures thereof, and the counterion, $X^-$, can be any softener-compatible anion, for example, methylsulfate, ethylsulfate, chloride, bromide, formate, sulfate, lactate, nitrate and the like, preferably methylsulfate. Preferably, —OC(O)R is derived from saturated or partially hydrogenated tallow.

The R group present in the DEQA will often be of mixed chain lengths rather than single chain lengths, since these materials are normally derived from natural fats and oils, or synthetically processed which produce a mixture of chain lengths. Also, it is often desirable to utilize mixtures of different chain lengths in order to modify the physical or performance characteristics of the softening composition.

Preferably, at least 80% of the DEQA is in the diester form, and from 0% to about 20%, preferably less than about 10%, more preferably less than about 5%, can be DEQA monoester (e.g., only one —$CH_2CH_2OC(O)R$ group). For optimal antistatic benefit monoester should be low, preferably less than about 2.5%. The level of monoester can be controlled in the manufacturing of the DEQA.

DEQA compounds prepared with fully saturated acyl groups are rapidly biodegradable and excellent softeners. However, compounds prepared with at least partially unsaturated acyl groups also have advantages (i.e., improved antistatic benefits) and are highly acceptable for consumer products when certain conditions are met.

Variables that must be adjusted to obtain the benefits of using unsaturated acyl groups include the Iodine Value of the fatty acids, the odor of fatty acid starting material, and/or the DEQA. Any reference to Iodine Value values hereinafter refers to Iodine Value of fatty acyl groups and not to the resulting DEQA compound.

Antistatic effects are especially important where the fabrics are dried in a tumble dryer, and/or where synthetic materials which generate static are used. As the Iodine Value is raised, there is a potential for odor problems.

Some highly desirable, readily available sources of fatty acids such as tallow, possess odors that remain with the compound DEQA despite the chemical and mechanical processing steps which convert the raw tallow to finished DEQA. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is often justified by the superior performance.

Generally, hydrogenation of fatty acids to reduce polyunsaturation and to lower Iodine Value to insure good color and odor stability leads to a high degree of trans configuration in the molecule. Therefore, diester compounds derived from fatty acyl groups having low Iodine Value values can be made by mixing fully hydrogenated fatty acid with touch hydrogenated fatty acid at a ratio which provides an Iodine Value of from about 3 to about 60. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc.

For unsaturated softener actives, the optimum storage temperature for stability and fluidity depends on the specific IV of, e.g., the fatty acid used to make DEQA and/or the level/type of solvent selected. Exposure to oxygen should be minimized to keep the unsaturated groups from oxidizing. It can therefore be important to store the material under a reduced oxygen atmosphere such as a nitrogen blanket. It is important to provide good molten storage stability to provide a commercially feasible raw material that will not degrade noticeably in the normal transportation/storage/handling of the material in manufacturing operations.

These compounds can be prepared by standard esterification and quaternization reactions, using readily available starting materials. General methods for preparation are disclosed in U.S. Pat. No. 4,137,180, incorporated herein by reference.

(B) Nonionic Softener

The nonionic softeners useful in the present invention are fatty acid partial esters of sorbitol, or anhydrides thereof, wherein each fatty acid moiety contains from about 8 to about 30, preferably from about 16 to about 20, carbon atoms. Typically, such softeners contain from about one to about 3, preferably about 2 fatty acid groups per molecule.

The fatty acid portion of the ester is normally derived from fatty acids having from about 8 to about 30, preferably from about 16 to about 20, carbon atoms. Typical examples of said fatty acids being lauric acid, myristic acid, palmitic acid, stearic acid, oleic acid, and behenic acid.

The level of nonionic softener in the solid composition is typically from about 15% to about 50%, preferably from about 25% to about 45%, and most preferably from about 30% to about 40%.

Highly preferred optional nonionic softening agents for use in the present invention are $C_{10}$–$C_{26}$ acyl sorbitan esters Sorbitan esters are esterified dehydration products of sorbitol. The preferred sorbitan ester comprises a member selected from the group consisting of $C_{10}$–$C_{26}$ acyl sorbitan monoesters and $C_{10}$–$C_{26}$ acyl sorbitan diesters and ethoxylates of said esters wherein one or more of the unesterified hydroxyl groups in said esters contain from 1 to about 4 oxyethylene units, and mixtures thereof. For the purpose of the present invention, sorbitan esters containing $C_{16}$–$C_{18}$ (e.g., sorbitan monostearate) are preferred.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide, fatty acid ester, and/or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society,* Vol. 45, October 1968.

Details, including formula, of the preferred sorbitan esters can be found in U.S. Pat. No. 4,128,484, incorporated hereinbefore by reference.

For the purposes of the present invention, it is preferred that a significant amount of di- and tri- sorbitan esters are present in the ester mixture. Ester mixtures having from 20–50% mono-ester, 25–50% di-esters and 10–35% of tri- and tetra-esters are preferred.

The material which is sold commercially as sorbitan mono-ester (e.g., monostearate) does in fact contain significant amounts of di- and tri-esters and a typical analysis of commercial sorbitan monostearate indicates that it comprises about 27% mono-, 32% di-, and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono-, di-, and tri-esters. Such mixtures are readily prepared by reacting the foregoing hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

The compositions described herein contain less than about 5%, preferably less than 2.5%, and most preferably essentially free of highly ethoxylated/propoxylated sugar derivatives as described in U.S. Pat. No. 5,376,287, Borcher, Sr. et al., issued Dec. 27, 1994, said patent being incorporated herein by reference.

(C) Optional Ingredients

Well known optional components included in fabric conditioning compositions are narrated in U.S. Pat. No. 4,103,047, Zaki et al., issued Jul. 25, 1978, for "Fabric Treatment Compositions," incorporated herein by reference.

(1) Optional Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink/Hardy/Trinh, issued Sep. 11, 1990, discloses specific preferred soil release agents comprising cationic functionalities, said patent being incorporated herein by reference.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

U.S. Pat. No. 4,976,879, Maldonado/Trinh/Gosselink, issued Dec. 11, 1990, discloses specific preferred soil release agents which can also provide improved antistat benefit, said patent being incorporated herein by reference.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials ZelconR 4780 (from DuPont) and MileaseR T (from ICI).

A more complete disclosure of these highly preferred soil release agents is contained in European Pat. Application 185,427, Gosselink, published Jun. 25, 1986, incorporated herein by reference.

(2) Cyclodextrin/Perfume Complexes and Free Perfume

The products herein can also contain from 0% to about 60%, preferably from about 1% to about 20%, cyclodextrin/perfume inclusion complexes, as disclosed in U.S. Pat. No. 5,139,687, Borcher et al., issued Aug. 18, 1992; and U.S. Pat. No. 5,234,610, Gardlik et al., to issue Aug. 10, 1993, which are incorporated herein by reference, and/or from 0% to about 10%, preferably from about 2% to about 5%, free perfume. Perfumes are highly desirable, can usually benefit from protection, and can be complexed with cyclodextrin. Fabric softening products typically contain perfume to provide an olfactory aesthetic benefit and/or to serve as a signal that the product is effective.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: U.S. Pat. No. 4,145,184, Brain and Cummins, issued Mar. 20, 1979; U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979, all of said patents being incorporated herein by reference. Many of the art recognized perfume compositions are relatively substantive, as described hereinafter, to maximize their odor effect on substrates. However, it is a special advantage of perfume delivery via the perfume/cyclodextrin complexes that non-substantive perfumes are also effective. The volatility and substantivity of perfumes is disclosed in U.S. Pat. No. 5,234,610, supra.

If a product contains both free and complexed perfume, the escaped perfume from the complex contributes to the overall perfume odor intensity, giving rise to a longer lasting perfume odor impression.

As disclosed in U.S. Pat. No. 5,234,610, supra, by adjusting the levels of free perfume and perfume/CD complex it is possible to provide a wide range of unique perfume profiles in terms of timing (release) and/or perfume identity (character). Solid, dryer-activated fabric conditioning compositions are a uniquely desirable way to apply the cyclodextrins, since they are applied at the very end of a fabric treatment regimen when the fabric is clean and when there are almost no additional treatments that can remove the cyclodextrin.

(3) Stabilizers

Stabilizers can be present in the compositions of the present invention. The term "stabilizer," as used herein, includes antioxidants and reductive agents. These agents can be present at a level of from 0% to about 2%, preferably from about 0.01% to about 0.2%, more preferably from about 0.05% to about 0.1% for antioxidants and more preferably from about 0.01% to about 0.2% for reductive agents. These assure good odor stability under long term storage conditions for the compositions. Use of antioxidants and reductive agent stabilizers is especially critical for unscented or low scent products (no or low perfume).

Examples of antioxidants that can be added to the compositions of this invention include ascorbic acid, ascorbic palmitate, propyl gallate, available from Eastman Chemical Products, Inc., under the trade names Tenox® PG and Tenox S-1; a mixture of BHT, BHA, propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA.

Examples of reductive agents include sodium borohydride, hypophosphorous acid, and mixtures thereof.

The stability of the compounds and compositions herein can be helped by the stabilizers, but in addition, the preparation of compounds used herein and the source of hydrophobic groups can be important. Surprisingly, some highly desirable, readily available sources of hydrophobic groups such as fatty acids from, e.g., tallow, possess odors that remain with the compound, e.g., DEQA despite the chemical and mechanical processing steps which convert the raw tallow to finished DEQA. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior performance which has not been recognized.

(4) Other Optional Ingredients

The present invention can include from 0% to about 5% other optional components (minor components) conventionally used in textile treatment compositions, for example, colorants, preservatives, optical brighteners, opacifiers, physical stabilizers such as guar gum and polyethylene glycol, anti-shrinkage agents, anti-wrinkle agents, fabric crisping agents, spotting agents, germicides, fungicides, anti-corrosion agents, antifoam agents, and the like.

(D) Substrate Articles

In preferred embodiments, the present invention encompasses articles of manufacture. Representative articles are those that are adapted to soften fabrics in an automatic laundry dryer, of the types disclosed in U.S. Pat. Nos.: U.S. Pat. No. 3,989,631 Marsan, issued Nov. 2, 1976; U.S. Pat. No. 4,055,248, Marsan, issued Oct. 25, 1977; U.S. Pat. No. 4,073,996, Bedenk et al., issued Feb. 14, 1978; U.S. Pat. No. 4,022,938, Zaki et al., issued May 10, 1977; U.S. Pat. No. 4,764,289, Trinh, issued Aug. 16, 1988; U.S. Pat. No. 4,808,086, Evans et al., issued Feb. 28, 1989; U.S. Pat. No. 4,103,047, Zaki et al., issued Jul. 25, 1978; U.S. Pat. No. 3,736,668, Dillarstone, issued Jun. 5, 1973; U.S. Pat. No. 3,701,202, Compa et al., issued Oct. 31, 1972; U.S. Pat. No. 3,634,947, Furgal, issued Jan. 18, 1972; U.S. Pat. No. 3,633,538, Hoeflin, issued Jan. 11, 1972; and U.S. Pat. No. 3,435,537, Rumsey, issued Apr. 1, 1969; and U.S. Pat. No. 4,000,340, Murphy et al., issued Dec. 28, 1976, all of said patents being incorporated herein by reference.

In a preferred substrate article embodiment, the fabric treatment compositions are provided as an article of manufacture in combination with a dispensing means such as a flexible substrate which effectively releases the composition in an automatic laundry (clothes) dryer. Such dispensing means can be designed for single usage or for multiple uses. The dispensing means can also be a "carrier material" that releases the fabric softener composition and then is dispersed and/or exhausted from the dryer.

The dispensing means will normally carry an effective amount of fabric treatment composition. Such effective amount typically provides sufficient fabric conditioning/antistatic agent and/or anionic polymeric soil release agent for at least one treatment of a minimum load in an automatic laundry dryer. Amounts of fabric treatment composition for multiple uses, e.g., up to about 30, can be used. Typical amounts for a single article can vary from about 0.25 g to about 100 g, preferably from about 0.5 g to about 20 g, most preferably from about 1 g to about 10 g.

A preferred substrate is described in allowed U.S. patent application Ser. No. 08/368,694, filed Jan. 4, 1995, by Childs, et al., said application is incorporated herein by reference. Other paper, woven or nonwoven "absorbent" substrates useful herein are fully disclosed in U.S. Pat. No. 3,686,025, Morton, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably 5 to 7, times its weight of water.

Another article comprises a sponge material releasably enclosing enough fabric treatment composition to effectively impart fabric soil release, antistatic effect and/or softness benefits during several cycles of clothes. This multi-use article can be made by filling a hollow sponge with about 20 grams of the fabric treatment composition.

(E) Usage

The substrate embodiment of this invention can be used for imparting the above-described fabric treatment composition to fabric to provide softening and/or antistatic effects to fabric in an automatic laundry dryer. Generally, the method of using the composition of the present invention comprises: commingling pieces of damp fabric by tumbling said fabric under heat in an automatic clothes dryer with an effective amount of the fabric treatment composition. At least the continuous phase of said composition has a melting point greater than about 35° C. and the composition is flowable at dryer operating temperature. This composition comprises from about 5% to about 90%, preferably from about 10% to about 75%, of the ethoxylated sugar derivative and from about 10% to about 95%, preferably from about 20% to about 75%, more preferably from about 20% to about 60% of the above-defined co-softeners.

The present invention relates to improved solid dryer-activated fabric softener compositions which are either (A) incorporated into articles of manufacture in which the compositions are, e.g., on a substrate, or are (B) in the form of particles (including, where appropriate, agglomerates, pellets, and tablets of said particles).

All percentages, ratios, and parts herein, in the Specification, Examples, and Claims, are by weight and approximations unless otherwise stated.

The following are nonlimiting examples of the instant articles, methods, and compositions of the present invention.

EXAMPLE 1

| Components | Wt. % |
|---|---|
| DEQA* (A) | 61.0 |
| Sobitan Monostearate (B) | 30.0 |
| Free Perfume (C)(2) | 4.0 |
| Clay** | 5.0 |
| | 100.0 |

*DEQA = $[CH_2CH_2OH][CH_3]^+N[CH_2CH_2OC(O)R]_2\ CH_3SO_4^-$, where OC(O)R is derived from partially hydrogenated tallow.
**Calcium bentonite clay, Bentolite ® L, sold by Southern Clay Products, or Gelwhite ® GP clay.

Preparation of the Coating Mix

An approximately 200 g batch of the coating mix is prepared as follows. An amount of about 122 g of DEQA and about 60 g of sorbitan monostearate (SMS) are melted separately at about 80° C. The DEQA and SMS are then combined with high shear mixing. During the mixing, the mixture is kept molten in a hot water bath at about 70–80° C. The calcium bentonite clay (about 10 g) is slowly added to the mixture with high shear mixing until the desired viscosity is achieved. The perfume (about 8 g) is added to the mixture, and the formula is mixed until the mixture is smooth and homogeneous.

Preparation of Fabric Conditioning Sheets

The coating mixture is applied to preweighed substrate sheets of about 9 inches×9 inches dimensions. The substrate sheets are described in Example 1 of allowed U.S. patent application Ser. No. 08/368,694, filed Jan. 4, 1995, by Childs, et al., said application is incorporated herein by reference. A small amount of the formula is placed on a heated metal plate with a spatula and then is spread evenly with a metal roller. A substrate sheet is placed on the metal plate to absorb the coating mixture. The sheet is then removed from the heated metal plate and allowed to cool to room temperature so that the coating mix can solidify. The sheet is weighed to determine the amount of coating mixture on the sheet. The target sheet weight is 3.04 g. If the weight is in excess of the target weight, the sheet is placed back on the heated metal plate to remelt the coating mixture and remove some of the excess. If the weight is under the target weight, the sheet is also placed on the heated metal plate and more coating mixture is added.

EXAMPLE 2

| Components | Wt. % |
|---|---|
| DEQA* (A) | 57.67 |
| Sobitan Monostearate (B) | 26.33 |
| Perfume/Cyclodextrin Complex (C)(2) | 16.0 |
| Clay** | 5.0 |
| | 100.0 |

*DEQA = $[CH_2CH_2OH][CH_3]^+N[CH_2CH_2OC(O)R]_2\ CH_3SO_4^-$, where OC(O)R is derived from partially hydrogenated tallow.
**Calcium bentonite clay, Bentolite L, sold by Southern Clay Products, or Gelwhite GP clay.

The preparation of the coating mix and the making of the fabric sheets is similar to 1 except that the free perfume is replaced by the perfume/cyclodextrin complex.

What is claimed is:

1. A dryer-activated fabric conditioning article comprising

I. a fabric conditioning composition wherein said composition comprises:

(a) a fabric softener component wherein said fabric softener component comprises a mixture of organic fabric softeners, said mixture of organic softeners consisting of:

(1) from about 30% to about 75% of a diester quaternary ammonium (DEQA) compound having the formula:

$$[CH_2CH_2OH][CH_3]^+N[CH_2CH_2OC(O)R]_2X^-$$

wherein R is independently selected from the group consisting of saturated and unsaturated $C_8$–$C_{30}$ hydrocarbyl substituents, and the counterion, $X^-$, can be any softener-compatible anion; and (2) fatty acid partial ester of sorbitan, wherein each fatty acid moiety contains from about 8 to about 30 carbon atoms, and wherein said partial ester contains from about 1 to about 3 fatty acid groups per molecule wherein the ratio of (a)(1) to (a)(2) is from about 1:1 to about 3:1; and (b) optional components selected from the group consisting of:

(1) from 0% to about 10% of soil release agent;

(2) from 0% to about 60% of cyclodextrin/perfume inclusion complexes and/or from 0% to about 10% free perfume; and (3) from 0% to about 2% of stabilizer; and II. a dispensing means which effectively releases the composition in an automatic clothes dryer.

2. The composition of claim 1 wherein, in I(a)(2), said partial ester of sorbitan is an ester mixture having from about 20% to about 50% monoester, from about 25% to about 50% diester, and from about 10% to about 35% of tri- and tetra-esters.

3. The composition of claim 2 wherein the quaternary ammonium compound I(a)(1) counterion $X^-$ is selected from the group consisting of methyl sulfate, ethyl sulfate, chloride, bromide, formate, sulfate, lactate, and nitrate.

4. The composition of claim 3 wherein, in I(a)(2), the fatty acid moiety forming said partial ester is selected from the group consisting of lauric, myristic, palmitic, stearic, oleic and mixtures thereof.

5. The composition of claim 1 containing from about 25% to about 45% of I(a)(2), and from about 50% to about 70% of I(a)(1).

6. The composition of claim 5 wherein, in I(a)(2), said partial ester of sorbitan is an ester mixture having from about 20% to about 50% monoester, from about 25% to about 50% diester, and from about 10% to about 35% of tri- and tetra-esters.

7. The composition of claim 6 wherein the quaternary ammonium compound I(a)(1) counterion $X^-$ is methylsulfate.

8. The composition of claim 1 containing from about 30% to about 40% of I(a)(2).

9. The composition of claim 8 containing from about 60% to about 65% of I(a)(1).

10. The composition of claim 9 wherein, in I(a)(2), said partial ester of sorbitan is an ester mixture having from about 20% to about 50% monoester, from about 25% to about 50% diester, and from about 10% to about 35% of tri- and tetra-esters.

11. The composition of claim 10 wherein the quaternary ammonium compound I(a)(1) counterion $X^-$ is methylsulfate, and wherein the composition contains from about 2% to about 5% free perfume.

12. A dryer-activated fabric conditioning article comprising

I. a fabric conditioning composition wherein said composition comprises:

(a) a fabric softener component wherein said fabric softener component comprises a mixture of organic fabric softeners, said mixture of organic softeners consisting of:

(1) from about 30% to about 75% of a diester quaternary ammonium (DEQA) compound having the formula:

$$[CH_2CH_2OH][CH_3]^+N[CH_2CH_2OC(O)R]_2X^-$$

wherein R is independently selected from the group consisting of saturated and unsaturated $C_8$–$C_{30}$ hydrocarbyl substituents, and the counterion, $X^-$, can be any softener-compatible anion; and (2) fatty acid partial ester of sorbitan, wherein each fatty acid moiety contains from about 8 to about 30 carbon atoms, and wherein said partial ester contains from about 1 to about 3 fatty acid groups per molecule wherein the ratio of(a)(1) to (a)(2) is from about 68:32 to about 55:45; and (b) optional components selected from the group consisting of:

(1) from 0% to about 10% of soil release agent;

(2) from 0% to about 60% of cyclodextrin/perfume inclusion complexes and/or from 0% to about 10% free perfume; and (3) from 0% to about 2% of stabilizer; and II. a dispensing means which effectively releases the composition in an automatic clothes dryer.

13. The composition of claim 12 wherein, in (B), the fatty acid moiety forming said partial ester is selected from the group consisting of lauric, myristic, palmitic, stearic, oleic and mixtures thereof.

14. The composition of claim 13 wherein the quaternary ammonium compound (A) counterion $X^-$ is methylsulfate.

15. The composition of either of claims 1 or 12 or wherein the dispensing means is a flexible substrate.

* * * * *